US005575353A

United States Patent [19]

Cafaro

[11] Patent Number: 5,575,353

[45] Date of Patent: Nov. 19, 1996

[54] DEVICE FOR BLOCKING STAIRS

[76] Inventor: Fred Cafaro, 124 Pamlico Ave., Ronkonkoma, N.Y. 11779

[21] Appl. No.: 495,827

[22] Filed: Jun. 28, 1995

[51] Int. Cl.[6] ..... E06C 7/18

[52] U.S. Cl. ..... 182/106; 182/107; 160/24; 52/182

[58] Field of Search ..... 160/127, 128, 160/24, 29, 280, 281, 282, 283, 284, 285, 286, 287, 288, 289, 290.1, 903, 323.1, 241; 52/182, 27; 182/106, 230, 107, 138

[56] References Cited

U.S. PATENT DOCUMENTS

| | | | |
|---|---|---|---|
| 1,054,535 | 2/1913 | Grigg | 160/323.1 |
| 1,755,232 | 4/1930 | Whitemore | 160/282 |
| 2,173,900 | 9/1939 | Dunn | 160/127 |
| 2,225,436 | 12/1940 | Lang | 160/290.1 X |
| 3,225,863 | 6/1964 | Ludlow . | |
| 3,372,772 | 5/1966 | Singer . | |
| 4,126,206 | 11/1978 | Becnel | 182/106 X |
| 4,373,569 | 2/1983 | Barettella | 160/323.1 X |
| 4,991,691 | 2/1991 | Brawer et al. | 52/182 X |

*Primary Examiner*—David M. Purol
*Attorney, Agent, or Firm*—Collard & Roe, P.C.

[57] ABSTRACT

A device for blocking stairs which is attached to the vertically-extending side panels of a stairway. A pair of expanding support elements is wedged between the side panels and separated from each other by a few steps. A material sheet is attached to, and extends between, the pair of expanding support elements. The material sheet covers the few steps so that access to the steps and the stairway is blocked. The support elements include outwardly-biased end plates equipped with rubber pads. One of the support rods has a rotationally-biased spool for retracting the material sheet during transport or storage.

9 Claims, 2 Drawing Sheets

DEVICE FOR BLOCKING STAIRS

BACKGROUND OF THE INVENTION

1. Field of the Invention

The present invention relates to a device for blocking stairs. More particularly it relates to a device which covers the first few lower stairs to block access to the stairway.

2. The Prior Art

Frequently, households with small children employ safety barriers to restrict them from certain parts of the house. The most common examples of such barriers are playpens and gates. Although a gate may be readily set up within a doorway, it is much more difficult to barricade other passageways, for instance, steps.

Steps are difficult to barricade because of the lack of the opposed planar surfaces which are needed to support conventional child gates. Certain prior art attempts to provide a safety guard for steps is disclosed in U.S. Pat. No. 3,225,863 and U.S. Pat. No. 3,372,772. Although these patents may effectively barricade the steps of a ladder, they do not specifically address the problem of barricading steps of a stairway. Accordingly it would be desirable to provide a device for blocking stairs which can be easily secured to any stairway.

SUMMARY OF THE INVENTION

It is therefore an object of the present invention to overcome the drawbacks of the prior art and to provide a device for blocking access to a stairway.

It is a further object of the present invention to provide such a device which is portable and easily adapted to stairways of any width.

These and other objects are achieved according to the invention by a device which is attached to the vertically-extending side panels of the stairway to block access to the steps. The device includes a pair of expanding support elements wedged between the side panels and separated from each other by a few steps. A plastic sheet is attached to and extends between the pair of expanding support elements, wherein the material sheet covers the few steps so that access to the steps and the stairway is blocked. The expanding support elements comprise a first axially-extending rod and a second axially-extending rod each having two end plates for frictionally engaging the side panel. Support elements further include means for axially displacing one of the two end plates outwardly, away from the other end plate. One of the rods includes an axially-extending spool attached to the material sheet.

The material sheet is wound onto the spool for storage of the device and unwound from the spool during use. The material sheet is rectangular with a width slightly smaller than the steps. The means for axially displacing the end plates comprises a coil spring for biasing one of the end plates outwardly, away from the respective rod. The rods each include a stop and the end plates each include an axle telescopically engaging the rod with the coil spring disposed adjacent the stop for biasing the axle outwardly. The coil spring is concentrically mounted about the axle.

The means for axially-displacing the end plate comprises a threaded member coupled to the rods and a correspondingly-threaded axle coupled to the end plate. The axle is rotated to axially displace the end plate relative to the rod. Each end plate includes a resilient pad mounted thereon for contact with the side panels without scratching.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
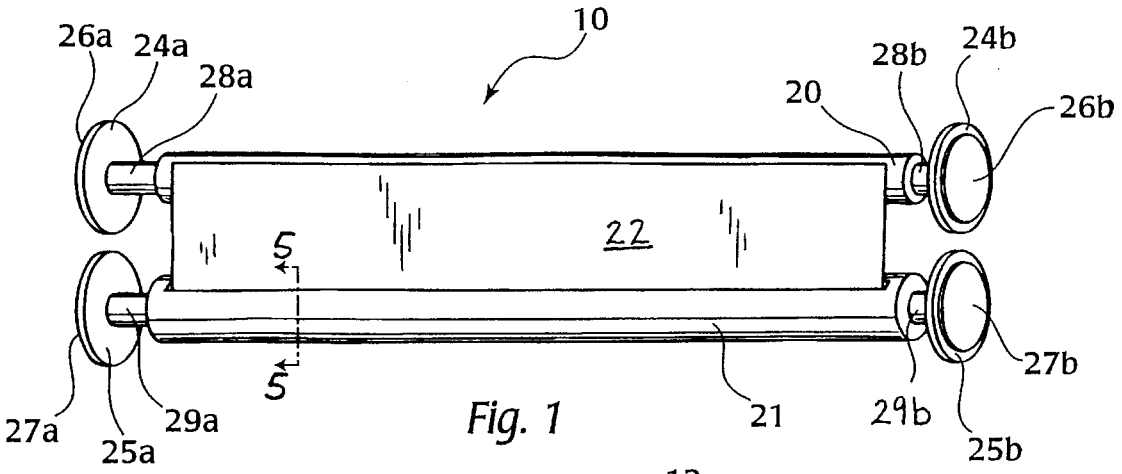
FIG. 1 is a perspective view of a stair blocker according the invention, with the material sheet substantially retracted within one of the support rods.
Figure 2:
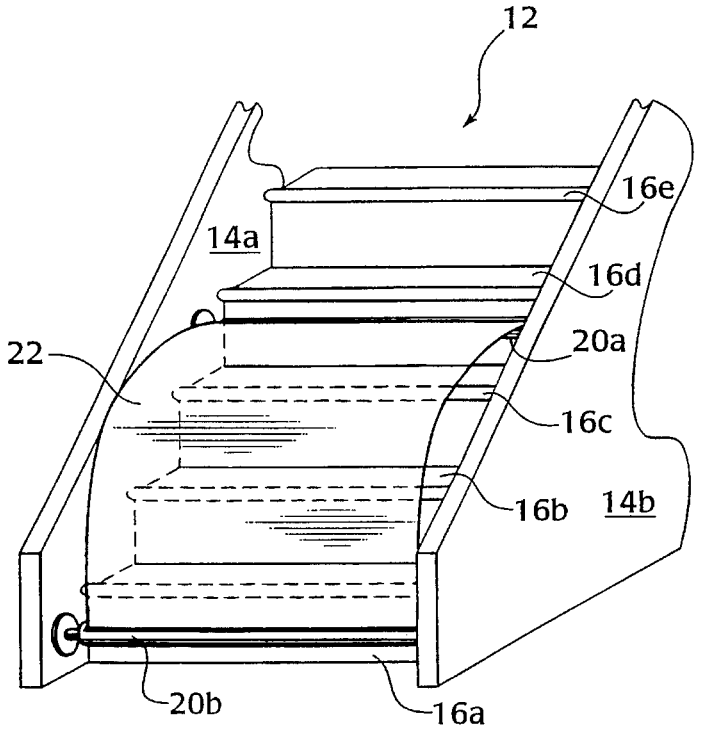
FIG. 2 is a perspective view of the stair blocker mounted over the three lower steps of a stairway.

Turning now in detail to the drawings and in particular, FIGS. 1 and 2 there is shown a stair blocker 10 which is used to block access to a stairway 12. Stair blocker 10 is wedged between side panels 14*a* and 14*b* of stairway 12 to cover and prevent access to stair 16*a*, 16*b*, and 16*c* of stairway 12 which additionally includes stairs 16*d*, 16*e*, etc.

Stair blocker 10 includes a support rod 20, an additional support rod 21 and a material sheet 22 which is attached to and extends between support rods 20 and 21. Support rod 20 includes end plates 24*a* and 24*b* which are mounted to support rod 20 for axial displacement by axles 28*a* and 28*b*. Rubber pads 26*a* and 26*b* are mounted on the outwardly-facing surfaces of end plates 24*a* and 24*b* to prevent marring or scratching of side panel 14*a* and 14*b*. Support rod 21 includes end plates 25*a* and 25*b* which are also equipped with rubber pads 27*a* and 27*b* and axles 29*a* and 29*b*.

In use, support rod 20 is positioned about three or four steps from the bottom landing. Axle 28*b* is extended outwardly to securely wedge rod 20 in position between side panels 14*a* and 14*b*. Material sheet 22 is uncoiled from within support rod 21, similar to a window shade. Support rod 21 is then positioned between the landing and the first step to completely cover and block access to the three lowest stairs 16*a*, 16*b*, and 16*c*. Axle 29*b* is extended outwardly to securely wedge rod 21 in position between side panels 14*a* and 14*b*.

Figure 3A:
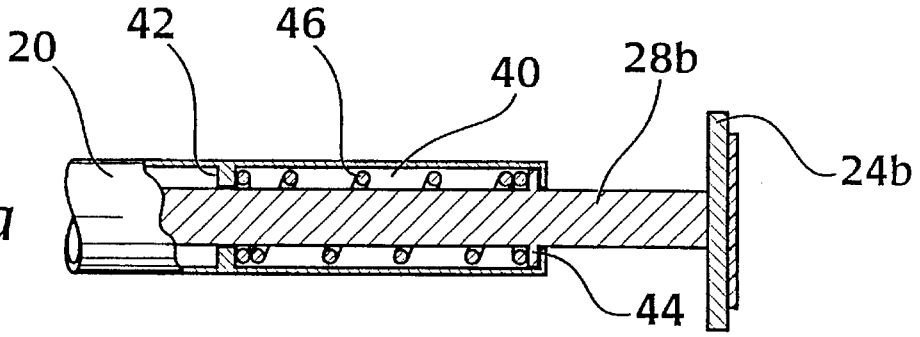
FIGS. 3*a* and 3*b* are partial cross-sectional views showing a spring-loaded end plate.
Figure 3B:
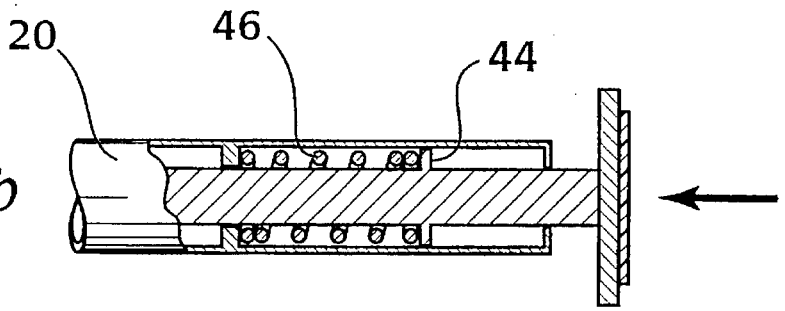

Referring now to FIGS. 3*a* and 3*b* there is shown a hollow end 40 of the support rods. An internal stop 42 is spaced from the end of the rod and includes a central opening which permits axle 28*b* to freely slide therethrough. Axle 28*b* is equipped with a collar 44. A spring 46 is concentrically mounted on axle 28*b* for biasing end plate 24*b* away from stop 42. To install support rod 20, end plate 24*b* is pressed inwardly to the left, as shown in FIG. 3*b*, against the expanding force of spring 46. Rod 20 is then positioned parallel to the surfaces of the stair, with end plate 24*a* pressed against side panel 14*a*. Upon releasing end plate 24*b*, the expanding force of spring 46 forces end plate 24*b* outwardly to the right against side panel 14*b*.

Figure 4:
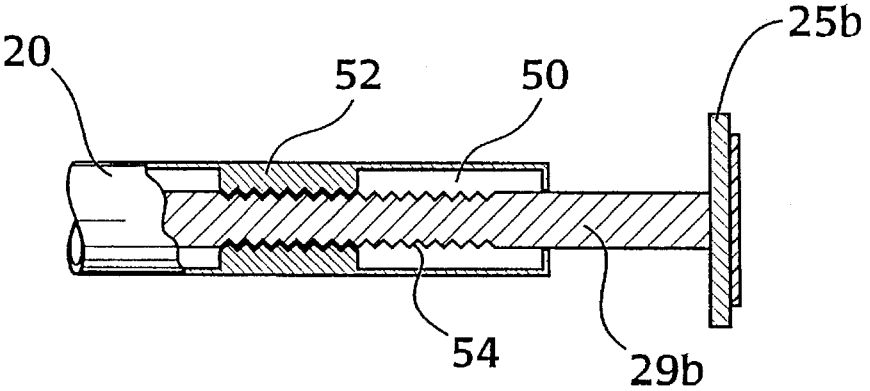
FIG. 4 is a partial cross-sectional view showing a threaded axle of an end plate.

In an alternate embodiment, rod 20 includes a hollow end 50 provided with a threaded stop 52. Axle 29*b* includes a correspondingly-threaded portion 54. Axle 29*b* is rotated to axially displace the end plate to secure rod 20 between side panels 14*a* and 14*b*. To install, axle 29*b* is screwed in until the total width of rod 20 is less than the distance between side panels 14*a* and 14*b*. End plate 25*a* is placed against side panel 14*a*. Axle 29*b* is unscrewed until end plate 25*b* is firmly seated against side panel 14*b*. The axially-expanding features shown in FIGS. 3*a*, 3*b*, and 4 allow rods 20 and 21 to be manufactured at a standard length, for example, short enough to fit the narrowest standard size stairway. The end plates are then axially extended to accommodate any wider stairways.

Figure 5:
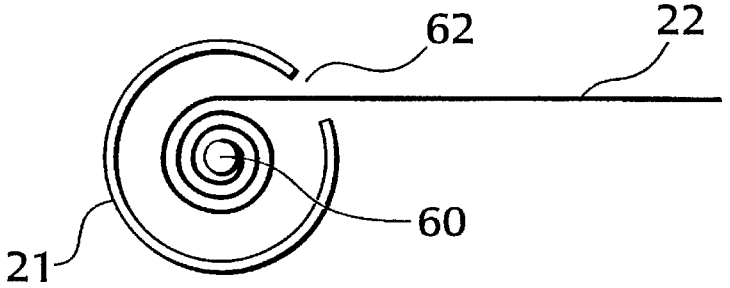
FIG. 5 is a cross-sectional view taken along the line 5—5 of FIG. 1.

FIG. 5 shows support rod 21 with a spool 60 and a slot 62. Spool 60 is rotationally biased in a counter-clockwise direction, for example by a coil spring. In a manner of operation similar to a window blind, material sheet 22 can be selectively retracted or extracted. Material sheet 22 is a rectangular sheet having a width slightly smaller than the narrowest standard size stairway, for example. Several models in different widths may be provided. Material sheet 22 has a length sufficient to extend over three or four stairs. Material sheet 22 is made from any type of cloth or resilient screening which may be stored in a roll and deployed to physically prevent small children from accessing the covered steps.

While several embodiments of the present invention have been shown and described, it is to be understood that many changes and modifications may be made thereunto without departing from the spirit and scope of the invention as defined in the appended claims.

What is claimed is:

1. A device attached to the vertically-extending side panels of a stairway for blocking access to the steps comprising:

a pair of axially-extending support rods, each rod being adapted to expand horizontally across the stairway and be frictionally retained between the side panels with said rods being spaced-apart from each other by a few steps; and a material sheet attached to, and extending between, said pair of support rods, wherein said material sheet is adapted to cover the few steps so that access to the steps and the stairway is blocked.

2. A device attached to the vertically-extending side panels of a stairway for blocking access to the steps comprising:

a pair of expanding support elements, each support element comprising an axially-extending rod having a first and a second end plate for frictionally engaging the side panels and means for axially displacing said first end plate outwardly, away from said second end plate, wherein each expanding support element is adapted to be frictionally retained between the side panels and separated from the other support element by a few steps; and a material sheet attached to, and extending between, said pair of expanding support elements, wherein said material sheet is adapted to cover the few steps so that access to the steps and the stairway is blocked.

3. The device according to claim 2, wherein said second rod includes an axially-extending spool attached to said material sheet, wherein said material sheet is wound onto said spool for storage of the device and unwound from said spool during use.

4. The device according to claim 3, wherein said material sheet is rectangular with a width slightly smaller than the steps.

5. The device according to claim 4, wherein said means for axially displacing comprises:

a coil spring for biasing said first end plate outwardly of the respective rod.

6. The device according to claim 5, wherein each rod includes a stop; and said first end plates each include an axle telescopically engaging said rods and a collar mounted on said axle, wherein said coil spring is disposed between said stop and said collar for biasing said axle outwardly.

7. The device according to claim 6, wherein said coil spring is concentrically mounted about said axle.

8. The device according to claim 4, wherein said means for axially displacing comprises:

a threaded stop coupled to said rods; and a correspondingly-threaded axle coupled to said first end plates, wherein said axles are rotated to axially displace said first end plates relative to the rod.

9. The device according to claim 4, wherein each end plate includes a resilient pad mounted thereon for contacting the side panels without scratching.

* * * * *